United States Patent [19]

Gossage

[11] Patent Number: 4,528,076

[45] Date of Patent: Jul. 9, 1985

[54] ELECTROCHEMICAL OXIDATION SYNTHESIS OF BIS-(5,5') -8 -ANILINO -1-NAPHTHALENE SULFONATE (BIS-ANS)

[76] Inventor: Henry E. Gossage, 6862 Skillman St., Apt. #151, Dallas, Tex. 75231

[21] Appl. No.: 667,325

[22] Filed: Nov. 1, 1984

[51] Int. Cl.[3] ..... C25B 3/02

[52] U.S. Cl. ..... 204/78

[58] Field of Search ..... 204/59 R, 72, 78

[56] References Cited

PUBLICATIONS

*Electrooxidation in Organic Chemistry* Yoshida Wiley-Interscience, New York, 1984, pp. 126–127.

*Primary Examiner*—John F. Niebling

*Attorney, Agent, or Firm*—Warren H. Kintzinger

[57] ABSTRACT

A process for the production of bis-(5,5')-8- Anilino -1-naphthalene Sulfonate using an electrochemical cell, consisting of a container (a beaker), a carbon cloth anode, and a metal cathode. The electrochemical cell is charged with ingredients in accord with the following proportions—2.136 g (6.71 mmol) of 8- anilino - 1- naphthalene sulfonic acid ammonium salt dissolved in 100 mL of 0.1 M aqueous sodium perchlorate. As the solution is stirred (A stirring mechanism is used such as a magnetic stirring bar with the container (beaker) supported on a combination heat plate and magnetic drive stirrer), the D.C. power supply voltage is increased until current begins to flow between the electrodes. This solution is electrolyzed for approximately two hours through which time periodic samples are removed and monitored by Hplc (high performance liquid chromatography) until the amount of product reaches a maximum. Thereafter, the solvent is removed and the residue dissolved in a minimal amount of methanol and chromatographed on a short column of neutral alumina using methanol as the eluent. The solvent is removed and the residue dissolved in a minimum amount of water. Excess barium acetate is added to precipitate bis-Ans as barium salt that is collected and dissolved in water. An excess of potassium sulfate is added to convert the barium salt to dipotassium salt. This salt is recrystallized to give 0.686 g (1.01 mmol) of bis - (5,5') - 8 - anilino - 1 - naphthalene sulfonic acid dipotassium salt corresponding to substantially a thirty percent product yield.

15 Claims, 2 Drawing Figures

Figure 1:
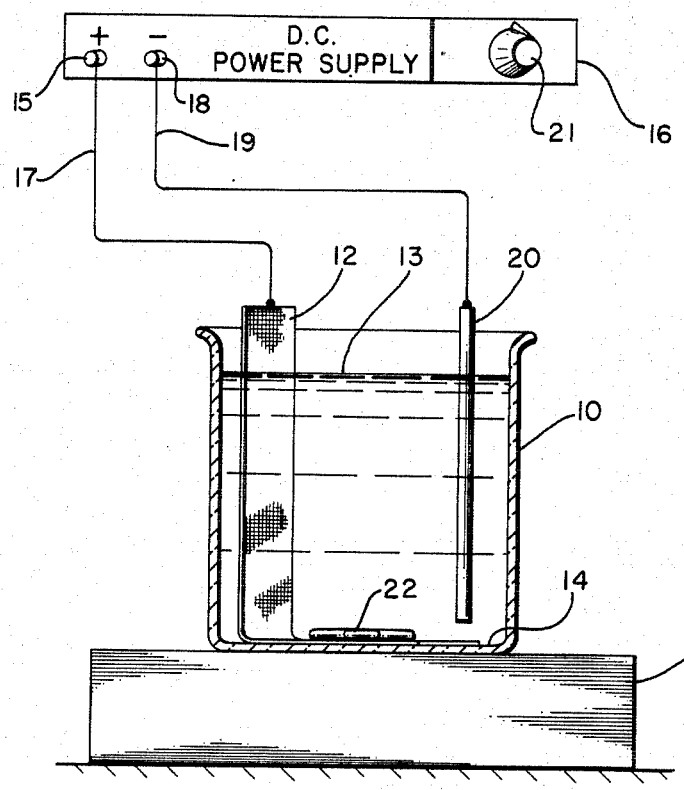

ELECTROCHEMICAL OXIDATION SYNTHESIS OF BIS-(5,5') -8 -ANILINO -1-NAPHTHALENE SULFONATE (BIS-ANS)

This invention relates in general to the synthesis of dimeric naphthylamines, and more particularly, to electrochemical oxidation synthesis of bis-Ans and other dimeric naphthylamines.

Fluorescent probes have been used extensively to investigate various aspects of protein structure and behavior. Information about binding sites, conformations, solvent interactions, intermolecular distances, and protein activities has been obtained using these probes. There are two types of fluorescence probes used, extrinsic and intrinsic. An extrinsic probe is added by the experimentalist to the system and it may be chemically bound to the molecule being studied or it may attach to the protein by non-covalent interactions. An example of an extrinsic probe is 8-anilino-1-napthalene sulfonate or Ans that binds non-covalently, probably by hydrophobic interaction with the proteins. The fluoresence intensity of Ans increases as the polarity of the environment decreases and the wavelength of maximum emission shifts to a shorter value. These changes in emission intensity or wavelength have been used to determine the polarity of the environment when Ans is associated with proteins and have also been used to monitor the kinetics of protein behavior.

Intrinsic probes are probes already contained in the molecule of which there are only three known for proteins. The most commonly used intrinsic probe is the indolyl group of the amino acid tryptophan. It has been demonstrated that the oxidative dimer of bis-(5,5')-8-anilino-1-naphthalene sulfonate or bis-Ans, as an extrinsic probe binds more tightly to proteins. The dissociation constant of bis-Ans is two orders of magnitude smaller than the dissociation constant of Ans with *Escherichia coli lac* repressor protein. The dissociation constant of bis-Ans on ribosomes is two orders of magnitude smaller than the dissociation constant of Ans with the same ribosomes. The increased binding strength of bis-Ans has been attributed to its larger size, causing an increased hydrophobic interaction with the protein. Bis-Ans also has a larger fluoresence quantum yield than Ans. The tighter binding and increased fluorescence intensity makes bis-Ans a more useful probe than Ans. Bis-Ans has been used in the study of multiple forms of lactate dehydrogenase, *Escherichia coli lac* repressor, pyruvate oxidase, RNA polymerase, myosin ATPase, ribosomes, and the regulatory subunits of adenosine cyclic 3', 5'-phosphate dependent protein kinase.

One reason why bis-Ans has not been more widely used is its expense. Currently bis-Ans is available from a few companies at a cost of about $3.00 per milligram. It is expensive because the current synthetic methods, that have been used to date, are tedious, involve difficult purifications, give low yields, and can only be conducted on a small scale (milligram). The best published method involves the reaction of 150 mg of Ans with $NaNO_2$ in four liters of solution. After a tedious workup, including column chromatography, 25 mg (17% yield) of bis-Ans is obtained.

It is therefore a principal object of this invention to provide an improved method for the preparation of the dimeric naphthylamine bis-Ans.

Another object is to provide an electrochemical oxidation synthesis approach for a family of dimeric naphthylamines more efficient than the chemical reaction synthesis approaches used heretofore.

Features of the invention useful in accomplishing the above objects include, in the electrochemical oxidation synthesis of bis-Ans and other dimeric naphthylamines, use of an electrochemical cell, consisting of a container (a beaker), a carbon cloth anode, and a metal cathode. In the production of bis-Ans, for example, the electrochemical cell is charged with ingredients in accord with the following proportions - 2.136 g (6.71 mmol) of 8-anilino-1-naphthalene sulfonic acid ammonium salt dissolved in 100 mL of 0.1 M aqueous sodium perchlorate. As the solution is stirred (a stirring mechanism is used such as a magnetic stirring bar with the container (beaker) supported on a combination heat plate and magnetic drive stirrer), the D.C. power supply voltage is increased until the current begins to flow between the electrodes. This solution volumn is electrolyzed for approximately two hours through which time periodic samples are removed and monitored by Hplc (high performance liquid chromatography) until the amount of product reaches a maximum. Thereafter, the solvent is removed and the residue dissolved in a minimal amount of methanol and chromatographed on a short column of neutral alumina using methanol as the eluent. The solvent is removed and the residue dissolved in a minimum amount of water. Excess barium acetate is added to precipitate bis-Ans as barium salt that is collected and dissolved in water. An excess of potassium sulfate is added to convert the barium salt to dipotassium salt. This salt is recrystallized to give 0.686 g (1.01 mmol) of bis-(5,5')-8-anilino-naphthalene sulfonic acid dipotassium salt corresponding to substantially a thirty percent product yield.

A specific process representing what is presently regarded as the best mode of carrying out the invention is illustrated in the accompanying drawing.

Figure 2:
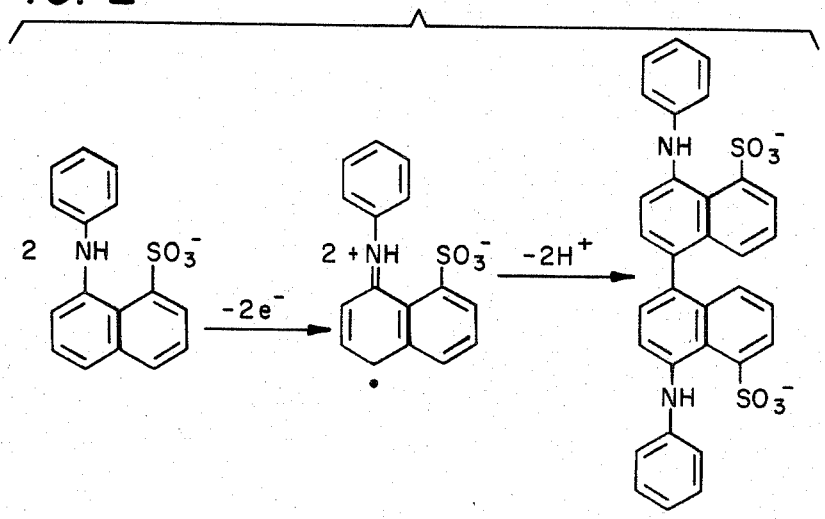

In the drawing:

FIG. 1 represents a side elevation schematic showing of the beaker container and electrochemical system used in bis-Ans synthesis and synthesis dimeric naphthylamines; and FIG. 2, an electrochemical compound processing diagram of molecular reactions in the synthetic process for production of bis-Ans.

Referring to the drawing:

A container 10 (in the form of a beaker) is shown in FIG. 1 in position on a combination hot plate and stirrer 11. A carbon cloth anode 12 is shown extending down into the fluid 13 contained in the beaker 10 and across a portion of the beaker bottom 14. The positive terminal 15 of an adjustable voltage level direct current (D.C.) power supply 16 has positive terminal 15 connected through line 17 to the carbon cloth anode 12 and a negative terminal 18 connected through line 19 to metal cathode 20 suspended for at least partial immersion in fluid 13 in the beaker 10. The knob 21 on the D.C. power supply 16 is adjustable for setting the D.C. voltage level, and a magnetic stirring bar 22 is positioned in the beaker 10 above the portion of the carbon cloth anode 12 extended over the bottom 14 of the beaker 10 for stirring action of the fluid 13 as driven by the stirrer 11.

Use of such equipment in an electrochemical oxidation process synthesis of bis-Ans and other dimeric naphthylamines included a Hewlett-Packard D.C.

power supply 16, a Union Carbide manufactured carbon cloth anode 12 and a metal (iron, copper, nickel, platinum) cathode 20 with a substantially constant potential being applied to an aqueous solution 13 containing sodium perchlorate and Ans. After the solution was electrolyzed for over one hour, the reaction mixture was analyzed by high performance liquid chromatography using SOAP chromatography with a reverse phase column. The retention times of the resulting peaks of the reaction mixture were identical to those of authentic samples of Ans and bis-Ans. The peak areas were determined and corresponded to a 35% yield of bis-(5,5')-8-Anilino-1-naphthalene Sulfonate at an 88% conversion of the starting material.

A second electrolysis using a carbon cloth anode and a metal cathode was performed in a beaker containing 2.14 g (6.71 mmol) of the compound 8-Anilino-1-naphthalene Sulfonate in aqueous sodium perchlorate over a two hour period. The solvent from the reaction mixture was removed and the residue was dissolved in methanol. The solution was chromatographed over neutral alumina. The solvent was removed from the fraction containing bis-(5,5')-8-Anilino-1-naphthalene Sulfonate and the residue was converted to the dipotassium salt. The product, bis-Ans was isolated in a 30% yield and was found to 85% pure by high performance liquid chromatography. The compound bis-(5,5')-8-Anilino-1-naphthalene Sulfonate was purified further by column chromatography and the product (99% pure) was identified by several methods. The retention time using high performance liquid chromatography was identical to that of an authentic sample of bis-Ans, bis (5,5')-8-Anilino-1-naphthalene Sulfonate, obtained from Molecular Probes Inc.

The emission spectrum of the compound bis-(5,5')-8-Anilino-1-naphthalene Sulfonate was identical to that of an authentic sample ($\lambda_{max}=518$ nm in water). The maximum absorption in the UV-VIS spectrum was 385 nm in water and was identical to that of an authentic sample of bis-(5,5')-8-Anilino-1-naphthalene Sulfonate. The extinction coefficient was $1.72\times10^3$ $M^{-1}$ $cm^{-1}$(Lit[8] $1.68\times10^{3M-1}$ $cm^{-1}$). The retention time for the authentic sample and the isolated product were identical with 2-propanol as the solvent on silica gel thin layer chromatography.

An electrochemical oxidation process of Ans to bis-Ans is diagrammed in FIG. 2 with 2 molecules of 8-Anilino-1-naphthalene Sulfonate (Ans) diagrammed on the left, in aqueous solution, being electrochemical processed through an intermediate unstable radical cation stage to yield the molecule product diagrammed on the right - bis-(5,5')-8-Anilino-1-naphthalane Sulfonate (bis-Ans). With the electrochemical system of FIG. 1 where a graphite rod or plate could be used in place of the carbon cloth anode 12 and a platinum surfaced cathode 20 was used it was determined that aromatic coumpounds tend to lay flat on the electrode surface, which facilitates electron transfer through the pi-system. While there is little information available as to where the chemical process occurs following the electron transfer process it appears that the chemical reaction occurs at the electrode surface following the electron transfer step. This electrochemical oxidation process is a superior method over strictly chemical processes in producing bis-naphthylamine products, since the reaction is so much faster and more efficient particularly with a much simpler product isolation process. Using this improved electrochemical oxidation process not only can Ans be processed to bis-Ans but also N-Phenyl-2-naphthylamine to bis-(1,1')-N-Phenyl-2-naphthylamine, and N-Phenyl-1-naphthylamine to bis-(4,4')-N-Phenyl-1-naphthylamine, giving excellent yields falling in the approximate range of 28 to 35 percent. In these electrochemical oxidation processes as the solution is being stirred the voltage is increased until current begins to flow between the electrodes at which time the oxidation electrochemical action is occuring through an electrolization period that may be varied some dependent on current flow used but generally in the range of one to two hours to achieve a reasonable completion of the process. In the process the positive voltage D.C. for effective process electrolization current flow to start and through the electrolization period falls in the approximate range of 0.25 to 1.4 volts D.C.

The improved electrochemical oxidation process is also extended to such oxidation of naphthylamine corresponding dimers as well as substituted naphthylamines to the corresponding dimers. N-Phenyl-naphthylamines, and N-toluyl-naphthylamines upon electrooxidation also generate their corresponding dimers. Dimers can also be generated from the electrooxidation of N-Phenyl-naphthylamines, N-Toluyl-naphthylamines, substitued N-Phenyl-naphthylamines, and substituted N-Toluyl-naphthylamines. Further, the electrooxidation of 8-(p-Toluidino)-1-naphthalene sulfonate generates its corresponding dimer bis-(5,5')-8-(p-Toluidino)-naphthalene sulfonate.

Whereas this invention has been described with respect to several related process embodiments thereof, it should be realized that various changes may be made without departure from the essential contributions to the art made by the teachings hereof.

I claim:

1. An electrochemical oxidation synthesis process for production of bis-Naphthylamine products comprising: the use of an electrochemical system including container means containing an aqueous solution, a carbon material anode, extending into the solution in said container, an electrially conductive metal cathode extended into the solution in said container, stirring means for stirring the solution, and a D.C. power supply, with D.C. voltage level adjustment means, having positive terminal connection means to said carbon material anode and negative terminal connection means to said metal cathode; charging said aqueous solution with a naphthylamine; increasing the D.C. voltage level of said D.C. power supply with said D.C. voltage level adjustment means until current begins to flow between said anode and cathode electrodes and then continuing electrolyzation period through a period of time to reasonable completion of the process.

2. The electrochemical oxidation synthesis process for production of bis-Naphthylamine products of claim 1, wherein said aqueous solution includes aqueous sodium perchlorate.

3. The electrochemical oxidation synthesis process for production of bis-Naphthylamine products of claim 2, wherein said stirring means stirs said solution as the D.C. voltage level is increased until current flows between said anode and said cathode electrodes and then for a period of continued electrolyzation.

4. The electrochemical oxidation synthesis process for production of bis-Naphthylamine products of claim 3, wherein said continuing electrolyzation period extends for a period of time falling in the range of approximately one half hour to three hours.

5. The electrochemical oxidation synthesis process for production of bis-Naphthylamine products of claim 3, wherein ingredients are charged to the solution in the electrochemical cell in accord with the following proportions- 2.136 g (6.71 mmol) of 8-Anilino-1-naphthalene sulfonic acid ammounium salt dissolved in 100 mL of O.M aqueous sodium perchlorate.

6. The electrochemical oxidation synthesis process for production of bis-Naphthylamine products of claim 3, wherein the electrochemical oxidation process is an Ans to bis-Ans process with two molecules of 8-Anilino-1-naphthalene sulfonate in aqueous solution being electrochemically processed through an intermediate unstable radical cation state to one molecule of product of bis-(5,5')-8-Anilino-1-naphthalene Sulfonate.

7. The electrochemical oxidation synthesis process for production of bis-Naphthylamine products of claim 3, wherein D.C. voltage level when current starts flowing between the anode and cathode electrodes is approximately a positive 0.44 D.C. voltage potential.

8. The electrochemical oxidation synthesis process for production of bis-Naphthylamine products of claim 1, wherein bis-Naphthylamine products produced are from the class consisting of bis-(5,5')-8-Anilino-1-naphthalene sulfonate, bis-(1,1')-N-Phenyl-2-naphthylamine, and bis-(4,4')-N-Phenyl1-naphthylamine.

9. The electrochemical oxidation synthesis process for production of bis-Naphthylamine products of claim 1, wherein said stirring means stirs said solution as the D.C. voltage level is increased until current flows between said anode and said cathode electrodes and then for a period of continued electrolyzation.

10. The electrochemical oxidation synthesis process for production of bis-Naphthylamine products of claim 9, wherein in the process the positive voltage D.C. for current flow to start and through the electrolyzation period falls in the approximate range of from 0.25 to 1.4 volts D.C.

11. The electrochemical oxidation synthesis process for production of bis-Naphthylamine products of claim 1, wherein said carbon material anode is in the form of a carbon cloth anode for optimized surface area contact with said aqueous solution; and with said container means being a substantially electrically non-conductive material container.

12. The electrochemical oxidation synthesis process for production of bis-Naphthylamine products of claim 1, wherein bis-Naphthylamine products include products of electrochemical oxidation of naphthylamine to the corresponding dimers, and substituted naphthylamines to corresponding dimers.

13. The electrochemical oxidation synthesis process for production of bis-Naphthylamine products of claim 1, wherein N-Phenyl-naphthylamines, and N-Toluyl-naphthylamines upon electrooxidation generate their corresponding dimers.

14. The electrochemical oxidation synthesis process for production of bis-Naphthylamine products of claim 1, wherein dimers are generated by electrooxidation, respectively, of N-Phenyl-naphthylamines, N-Toluyl-naphthylamines, substituted N-Phenyl-naphthylamines, and substituted N-Toluyl-naphthylamines.

15. The elctrochemical oxidation synthesis process for production of bis-Naphthylamine products of claim 1, wherein electrooxidation of 8-(p-Toluidino)-1-naphthalene sulfonate generates its corresponding dimer bis-(5,5')-8-(p-Toluidino)-1-naphthalene sulfonate.

* * * * *